US006241092B1

(12) United States Patent
Vasudeva

(10) Patent No.: US 6,241,092 B1
(45) Date of Patent: Jun. 5, 2001

(54) HOLDER WITH SHAFT SECURITY MECHANISM FOR SCREWDRIVERS OR THE LIKE

(75) Inventor: Kailash C. Vasudeva, Waterloo (CA)

(73) Assignee: Maxtech Manufacturing Inc., Waterloo (CA)

( * ) Notice: Subject to any disclaimer, the term of this patent is extended or adjusted under 35 U.S.C. 154(b) by 0 days.

(21) Appl. No.: 09/373,630

(22) Filed: Aug. 13, 1999

Related U.S. Application Data

(60) Provisional application No. 60/096,693, filed on Aug. 14, 1998.

(51) Int. Cl.[7] ..... A45C 11/26

(52) U.S. Cl. ..... 206/349; 206/372; 206/481; 211/70.6; 220/326

(58) Field of Search ..... 206/349, 372, 206/481, 486, 376; 211/70.6; 220/326

(56) References Cited

U.S. PATENT DOCUMENTS 5,577,779 * 11/1996 Dangel ..... 292/80
5,713,467 * 2/1998 Kao ..... 206/481
5,816,401 * 10/1998 Vasudeva et al. ..... 206/481
5,819,932 * 10/1998 Norbits ..... 206/349
5,918,741 * 7/1999 Vasudeva ..... 206/376
5,988,381 * 11/1999 Ling ..... 206/349

* cited by examiner

*Primary Examiner*—Paul T. Sewell
*Assistant Examiner*—Troy Arnold
(74) *Attorney, Agent, or Firm*—R. Craig Armstrong

(57) ABSTRACT

A security mechanism adapted to a tool holder comprising a first member and a second member pivotally connected to the first, each of the members having a recessed portion defined on a mating surface to receive a portion of a tool shaft whereby a handle portion and/or other part of the secured tool is positioned outside of the security mechanism and the holder and is accessible to a user. The shaft security mechanism includes, preferably, a variable position locking means for securing the first and second members in the closed position in one of a number of locking positions. Preferably, a compressible insert slidably mountable onto the tool shaft portion may be inserted and registered into a cavity further defined by the recessed portions of the first and second members when the security mechanism is in an open position.

14 Claims, 19 Drawing Sheets

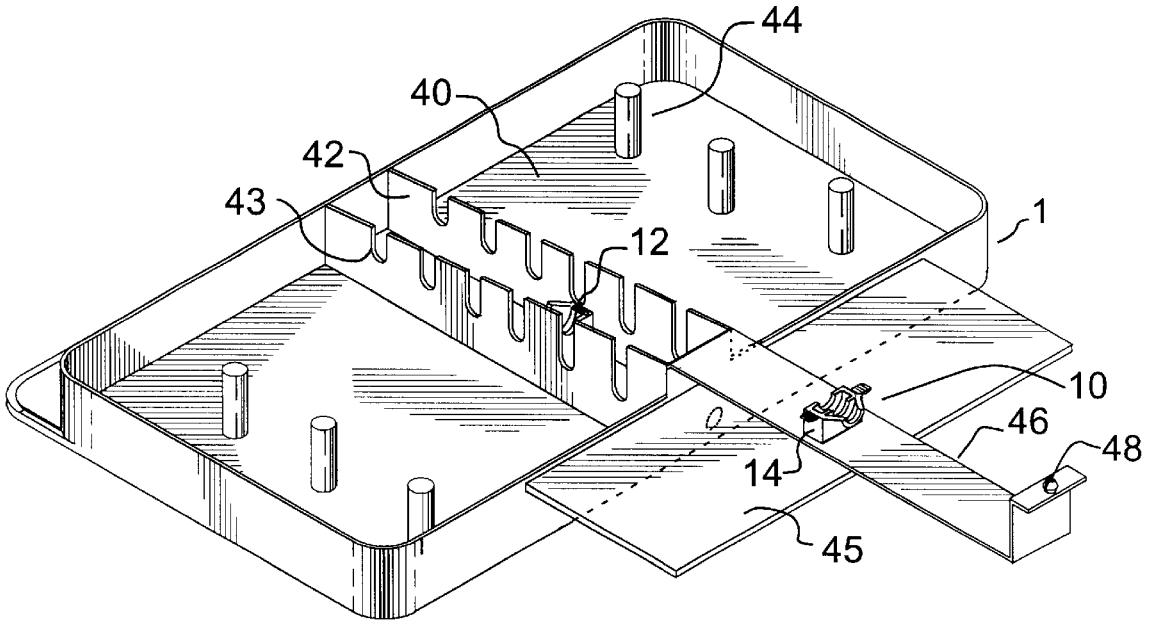
FIG.13
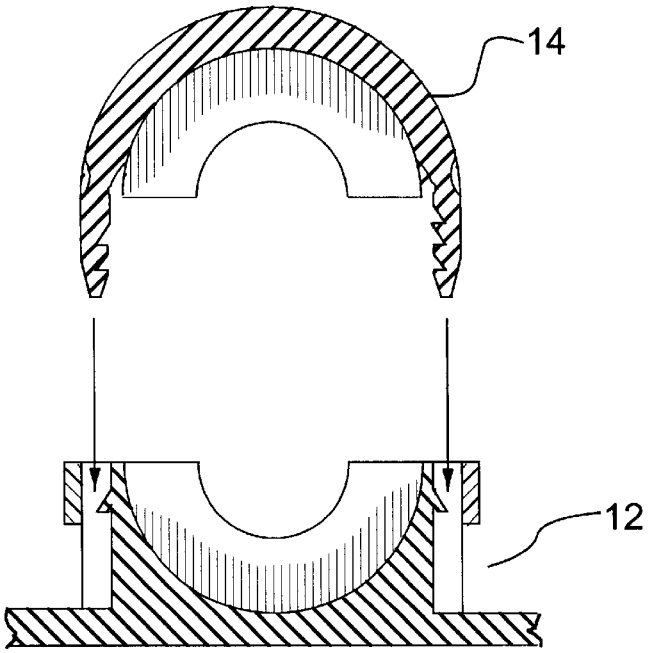
FIG.13.A

HOLDER WITH SHAFT SECURITY MECHANISM FOR SCREWDRIVERS OR THE LIKE

REFERENCE TO RELATED APPLICATION

This is a formal application based on and claiming the benefit of provisional application Ser. No. 60/096,693, filed Aug. 14, 1998.

BACKGROUND OF THE INVENTION

1. Field of the Invention

This invention relates to tool holders with shaft security mechanisms, i.e. means to retain tools in their packaging, via shaft portions thereof, for example, such that they are impossible or at least difficult to remove while the packaging remains in place.

The invention is particularly applicable to screwdrivers and the like, but could be used for any article having a generally straight shaft or shank, whether round, square, hexagonal or otherwise shaped in cross-section. Other examples of tools or tool components which could be retained would include nut drivers, drills, taps, hex power bits, etc., for example.

2. Description of the Prior Art

Traditional screwdriver holders comprise multiple parts, for example a holder base and a twist tie wrapped about the handle portion of the screwdriver to hold the screwdriver to the holder. There a number of problems with these traditional holders. First, the screwdriver is not actually secure from product price switching by unscrupulous individuals. Because screwdrivers in traditional packaging/holders are easily removable therefrom, an unscrupulous individual may remove the tool from a higher priced packaging/holder and insert the desired tool into a lesser priced package/holder. To resolve the problem of product price switching some traditional packaging/holders keep the screwdriver in a completely sealed box or compartment. The problem with this latter form of packaging is that the potential customer does not have an opportunity to grip and feel the handle of the tool before purchasing. Market research shows that allowing the potential customer accessibility to the grip and feel of the handle portion of the screwdriver will give the customer a better assessment of whether to screwdriver is best suited for his/her purposes and taste.

Accordingly, there exists a need for a screwdriver holder that can securely hold the screwdriver in the packaging/holder it is originally packaged in while at the same time allowing the potential customer to feel and grip the full length of the handle portion.

SUMMARY OF THE INVENTION

It is an object of the invention to overcome some of the drawbacks of traditional tool holders.

It is another object of the invention to provide an one piece holder that permits a potential customer to grip and feel the handle portion of the tool he/she is intending to purchase without removing the same from the holder.

The invention therefore provides a tool holder having a shaft security mechanism adapted to the holder, comprising a first member and a second member securable to the first member, each of the members having a recessed portion defined in a mating surface, the security mechanism being positionable between an open position where the first and second members are displaced from one another, and a closed position where the first and second members mate with one another and secure a shaft portion of a tool passing through the recessed portion. A locking means is secures the first and second members in the closed position.

Further features of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which:

FIG. 13 is a perspective view of a multiple screwdriver holder;

FIG. 13*a* is a cross-sectional view through a second embodiment of the shaft security mechanism;

DETAILED DESCRIPTION OF THE PREFERRED EMBODIMENT

Figure 1A:
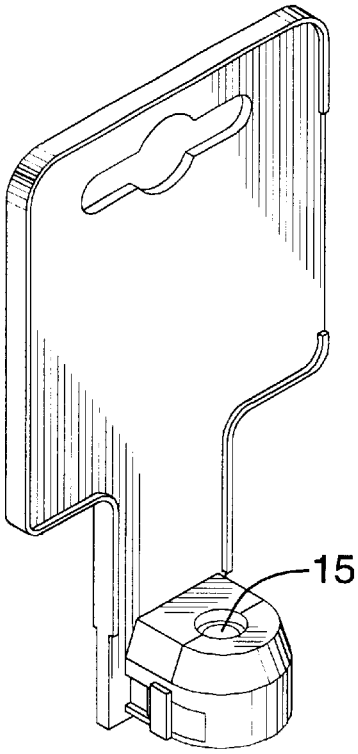
FIG. 1*a* is a perspective view of the holder without a screwdriver.
Figure 1:
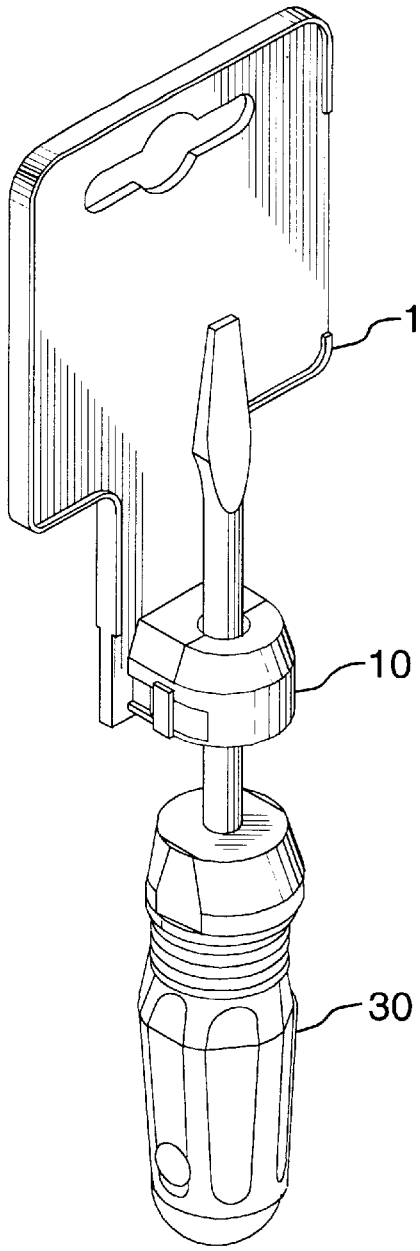
FIG. 1 is a perspective view of the holder with a single screwdriver being secured.

A preferred embodiment of the invention is shown in FIGS. 1–12. With reference to FIG. 1 there is shown a single tool holder, generally designated as 1, with a shaft security mechanism 10 disposed at a lower portion thereof for securing a shaft portion of a screwdriver 30 or the like. The holder will preferably have a tab opening near a top end thereof for receiving a displaying shelving rod since the practical application of this holder will be in retail or wholesale settings. The holder and shaft security mechanism will be typically integrally molded from plastic or other suitable material.

Figure 2:
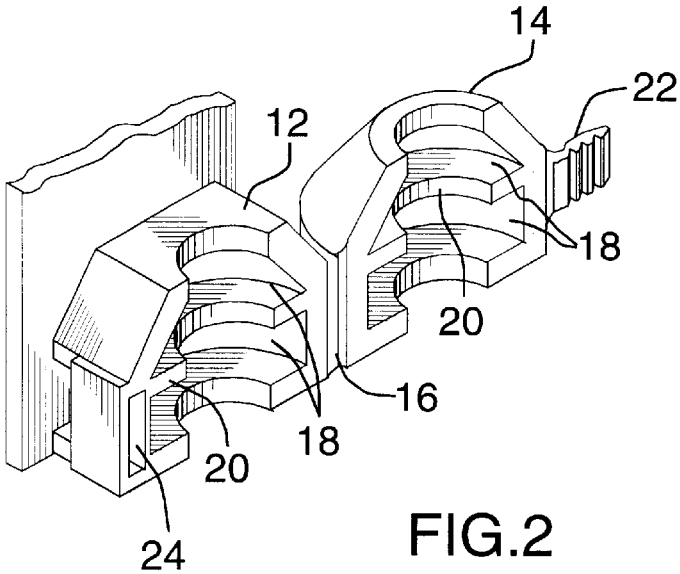
FIG. 2 is a close-up perspective view of a shaft security mechanism in an open position.

The security mechanism is positionable between an open position, as shown in FIG. 2, and a closed position, as shown in FIG. 1 and 1*a*. The security mechanism comprises a stationary first half 12 abutting the face of the holder and a second half 14 connected to the first half via, preferably, a living hinge 16. On the mating surfaces of the first and second halves is a recessed cavity, generally designated 18. In the preferred embodiment, the recessed cavity is shaped so as to house a compressible washer/insert/grommet 11 snugly therein. In this preferred embodiment, the cavity has an intermediate tier 20 to assist in retaining the compressible insert in place and generally resisting any upward or downward shifting of the shaft when the secured tool is yanked by a customer. The mechanism includes a variable position locking means preferably comprising a ratcheting teeth tab 22 that is insertable into receiving end 24 and locked by one-way pin 26. Although only three teeth are shown in the drawings, a different number of teeth will also work. Likewise, the halves can be of different shapes and sizes than illustrated, but still fall within the scope of the invention. Other variable position locking means are possible that will achieve the same result. One such alternative embodiment is illustrated in FIG. 13*a*.

In this second embodiment, there are two ratcheting teeth tabs instead of one. In all cases, however, the variable position locking means permits the assembler to adjust the security level of the security mechanism for each retailer/wholesaler's particular requirement, by selecting one of a number of locking positions, ranging from somewhat loose to very tight.

Figure 4:
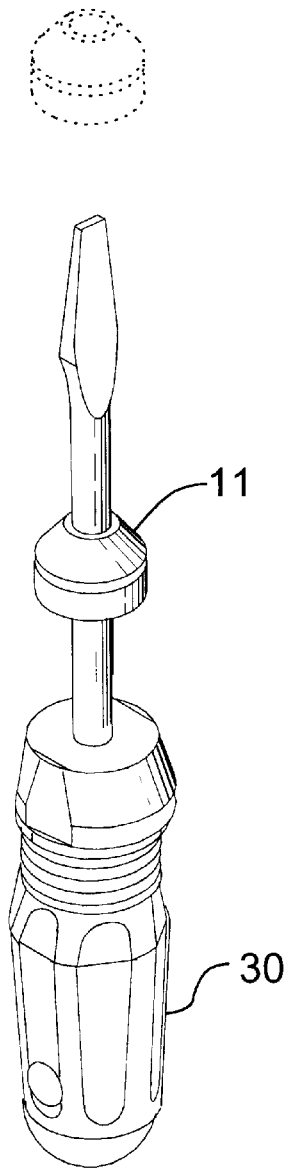
FIG. 4 is a perspective view of the screwdriver and compressible insert.
Figure 6:
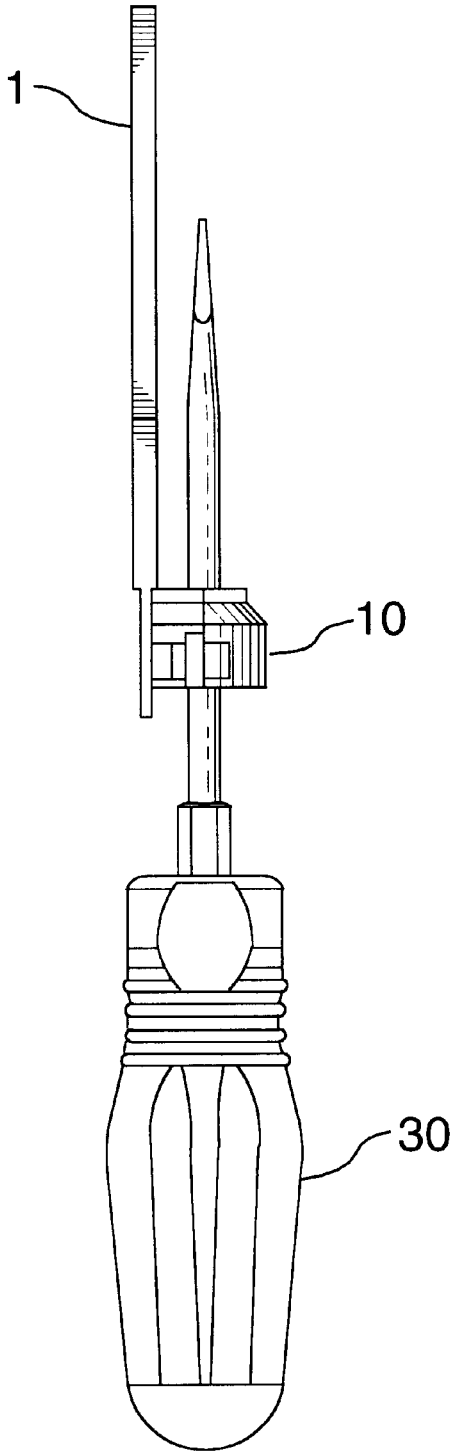
FIG. 6 is a side view of FIG. 5.
Figure 5:
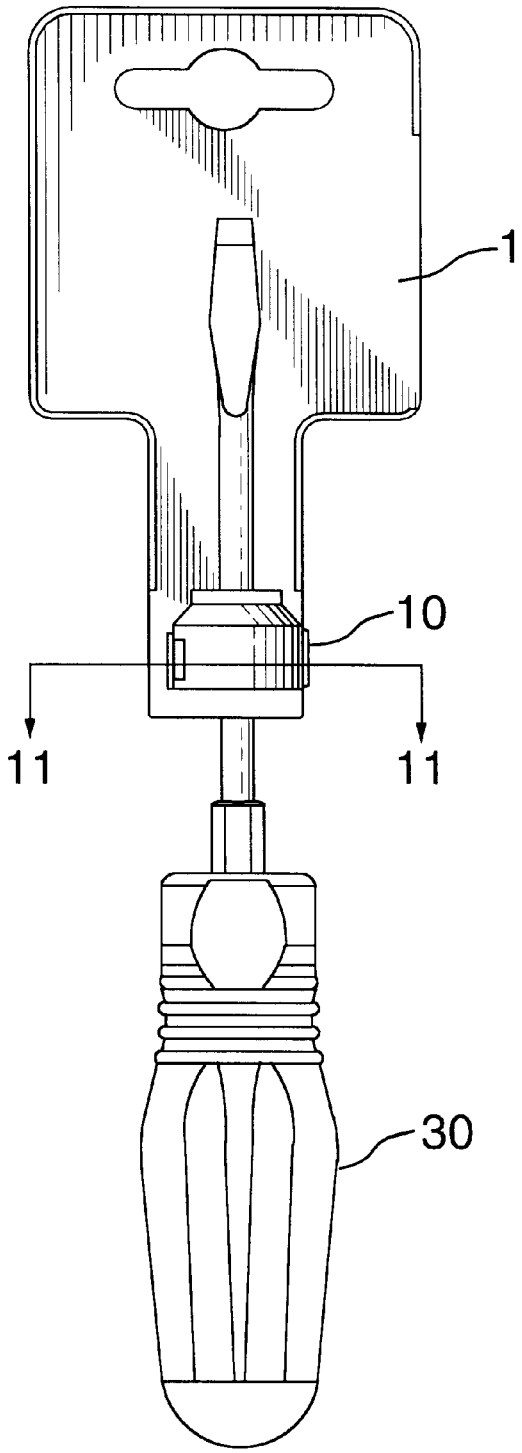
FIG. 5 is a front view of the holder and secured screwdriver.

With reference to FIG. 4, the compressible insert 11 has a central bore extending therethrough and is made of a material that is sufficiently elastic, such as PVC, Santoprene™ or rubber, so as to allow the insert to be slidably mountable onto the shaft of a tool regardless of whether the tip of a screwdriver has flared sides or not.

Figure 3:
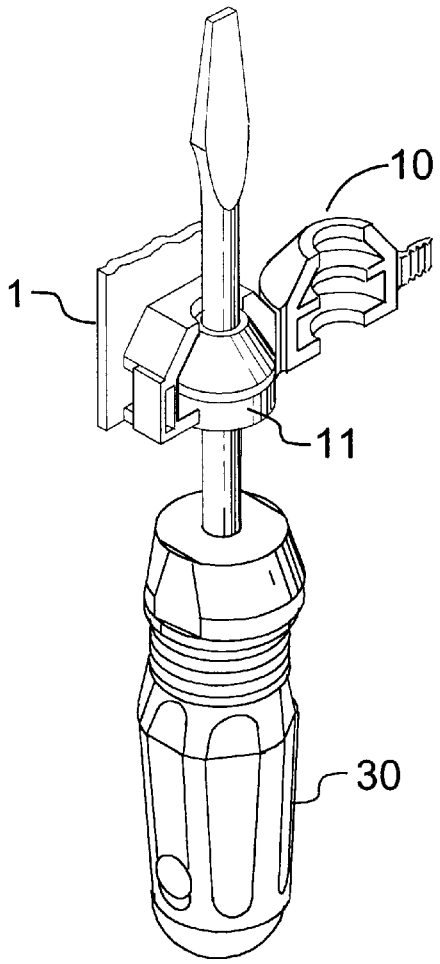
FIG. 3 is a perspective view of a shaft mounted compressible insert installed into an open shaft security mechanism.
Figure 7:
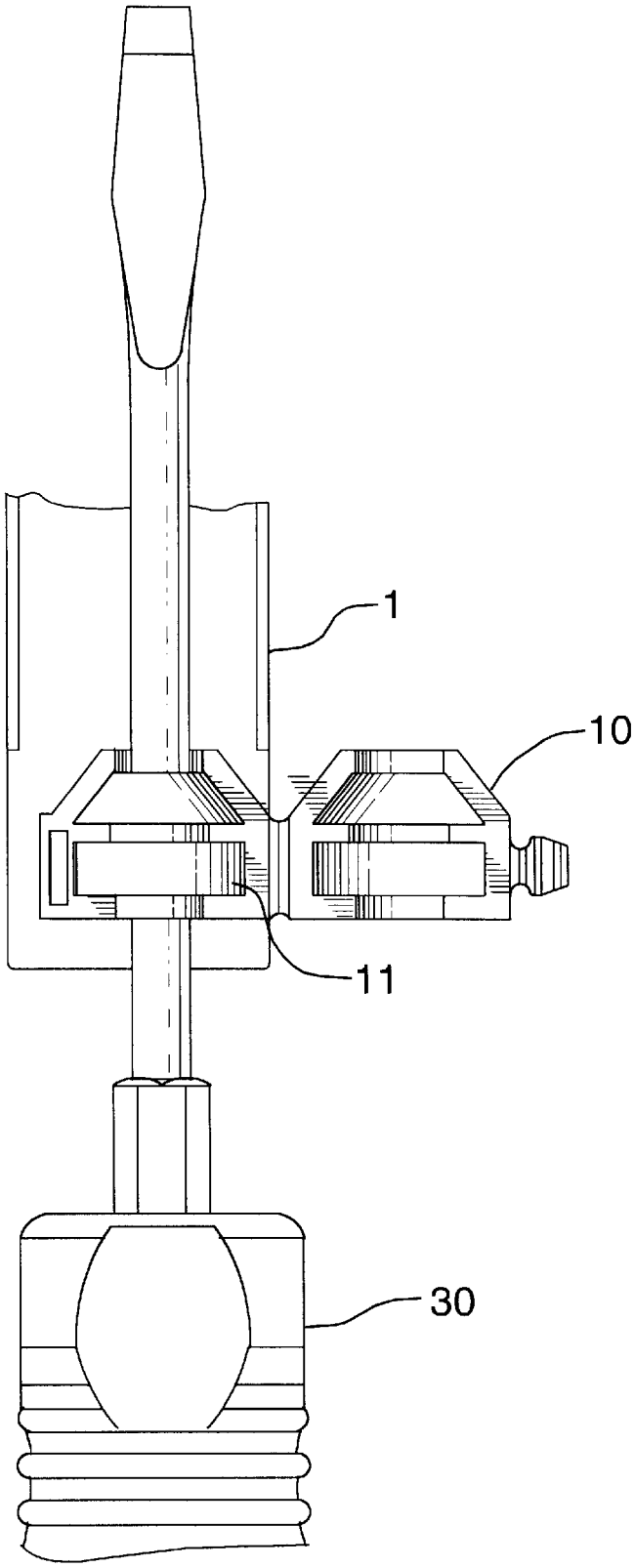
FIG. 7 is a close-up front view of FIG. 3.
Figure 8:
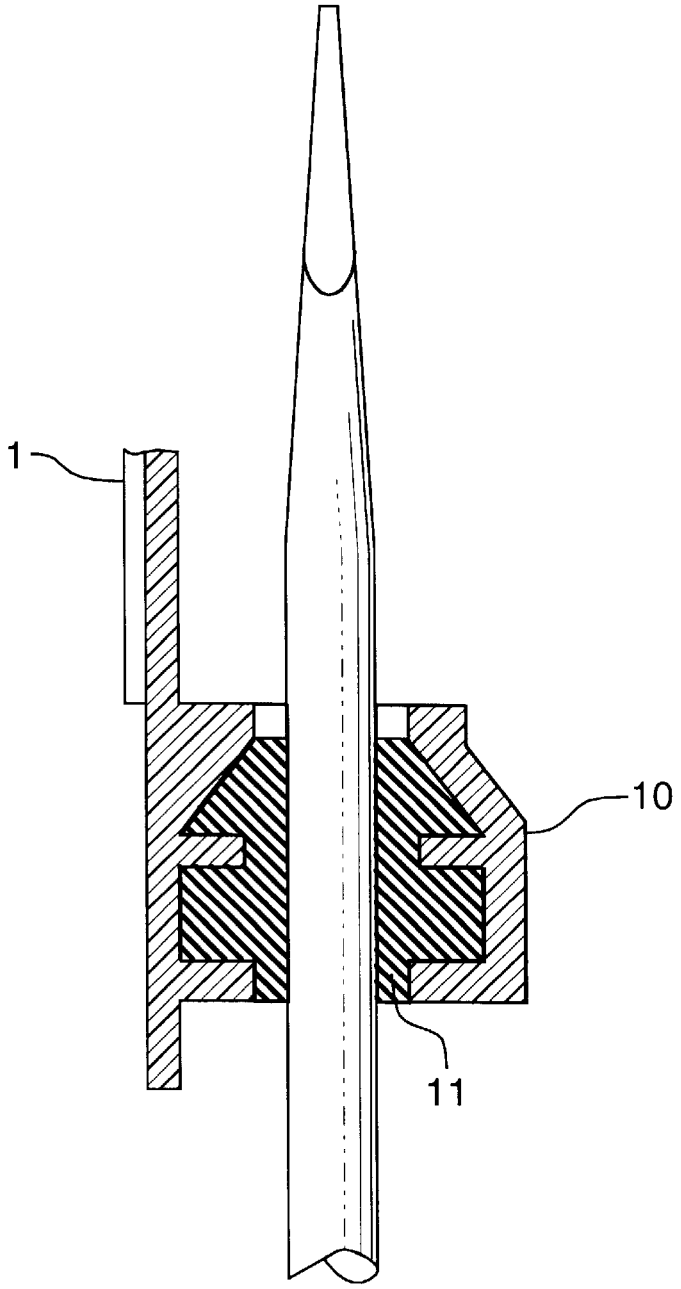
FIG. 8 is a partial side cross-sectional view through shaft security mechanism.
Figure 9:
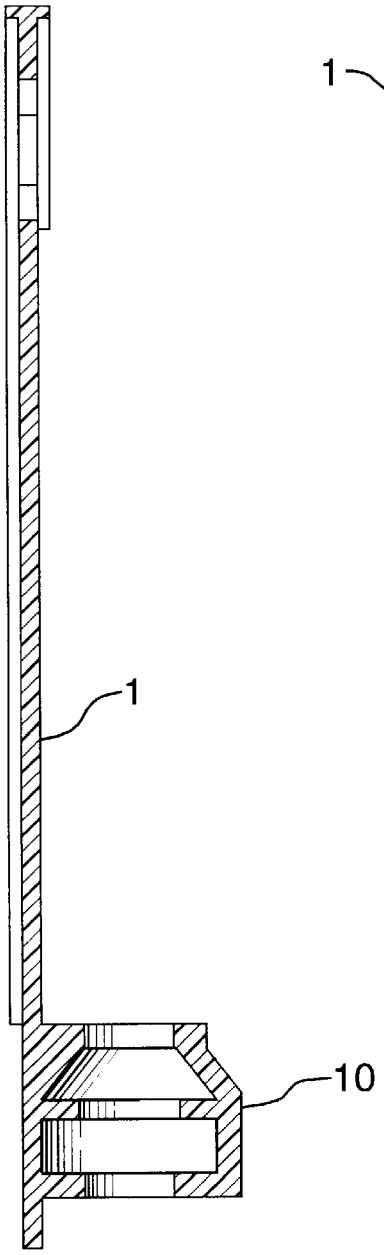
FIG. 9 is a side cross-sectional view through the holder.
Figure 12:
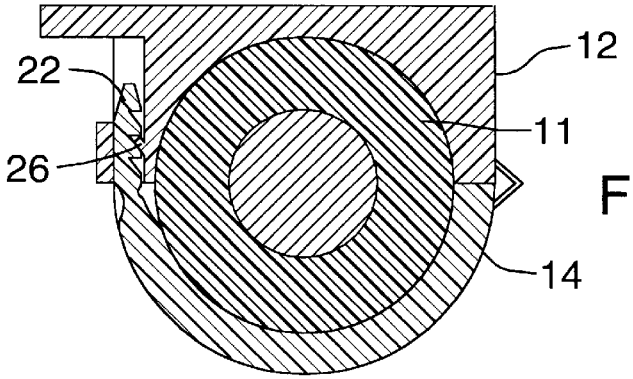
FIGS. 11–12 are top cross-sectional views of the shaft security mechanism illustrating how the mechanism is locked.
Figure 11:
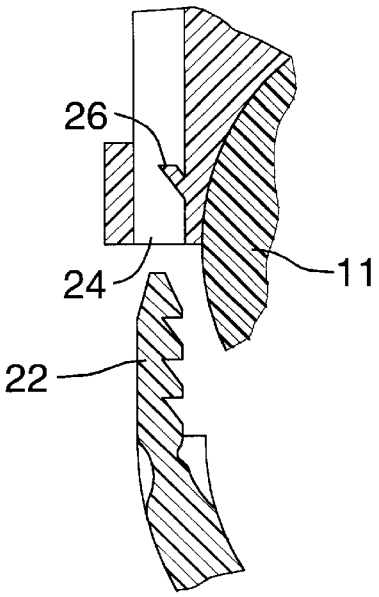
Figure 11A:
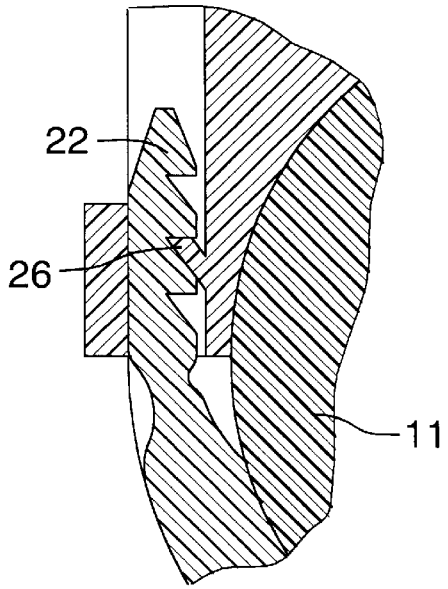
Figure 10:
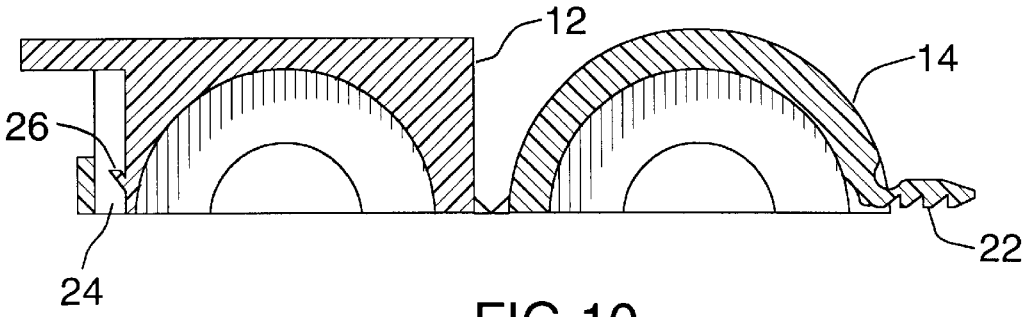
FIG. 10 is a top cross-sectional view through an open shaft security mechanism.
Figure 14:
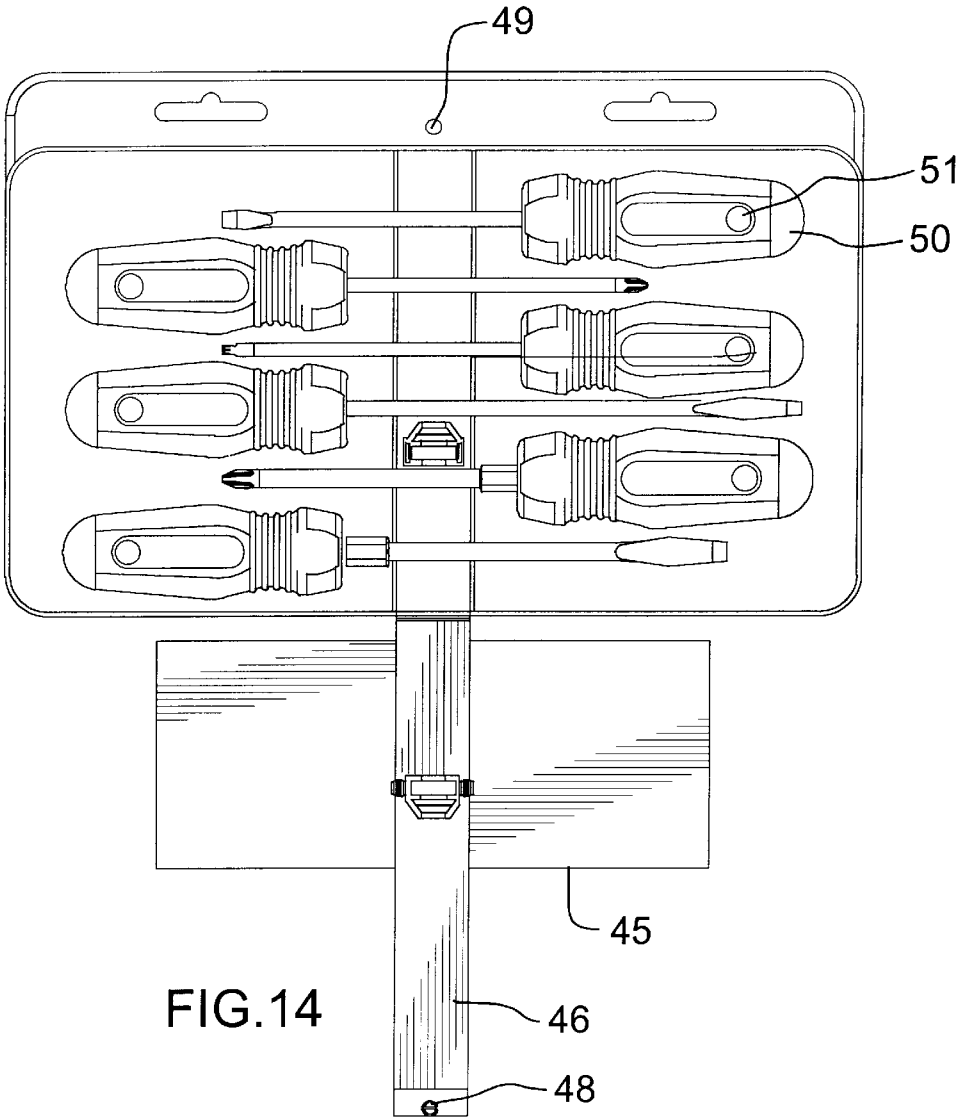
FIG. 14 is a plan view of an unsecured multiple screwdriver holder.
Figure 15:
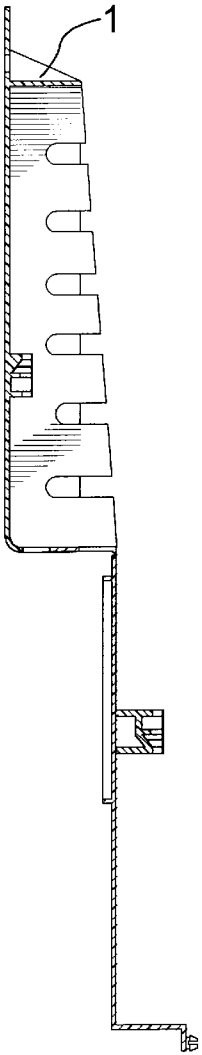
FIG. 15 is a sectional view of the multiple screwdriver holder.
Figure 16:
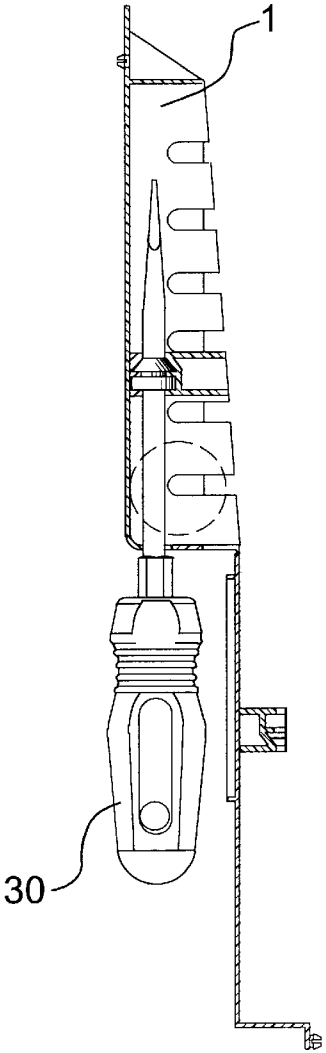
FIG. 16 is a sectional view of the multiple screwdriver holder with a screwdriver positioned in the shaft security mechanism.
Figure 17:
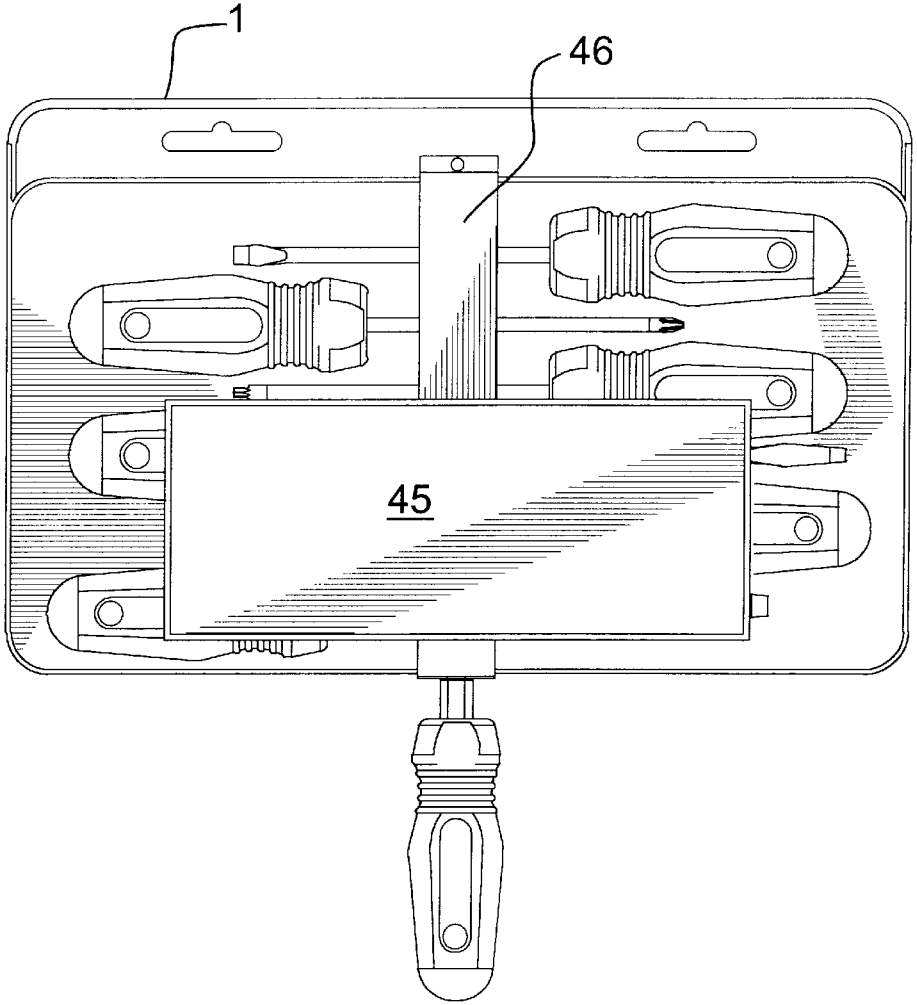
FIG. 17 is a plan view of the multiple holder with a screwdriver secured therein.
Figure 18:
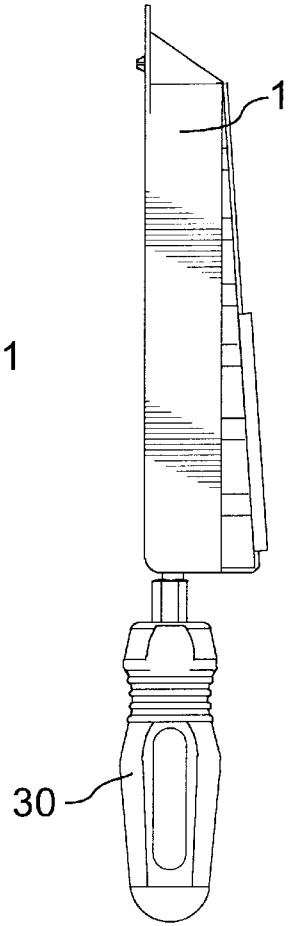
FIG. 18 is a side view of the multiple holder with a screwdriver secured therein.
Figure 19:
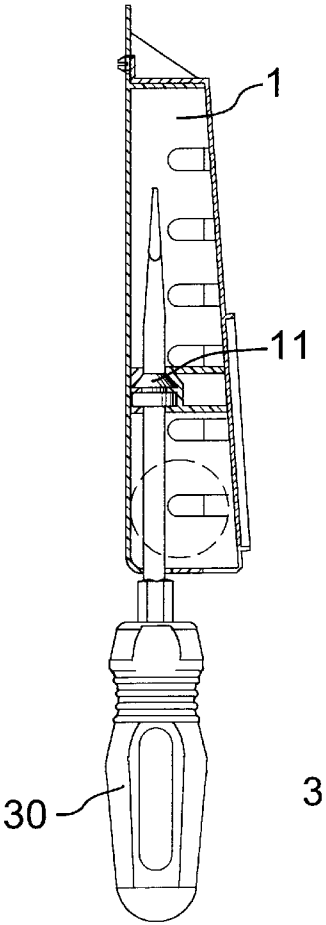
FIG. 19 is a sectional view of FIG. 18.

In the same sense, the compressible insert may be slid off the shaft when no longer required. However, the material and/or fit is such that it resists movement along the shaft unless considerable force is applied. In a preferred embodiment, the compressible insert has two spaced-apart portions radially extending from a central shaft, the top portion of which is bevelled. When the security mechanism is in the open position, the shaft mounted insert is positioned therein as shown in FIGS. 3 and 7. After insertion, the tool is secured to the holder by simply closing the second half of the security mechanism against the first half and locking the same. An illustration of how the shaft of tool is secured to the holder via the insert is shown in FIGS. 3, 7 and 10–12.

Depending on the security packaging requirements of the retailer/wholesaler a wide range of security levels may be achieved with this shaft security mechanism. In situations where the requirements call for high security means, the assembler of the holder and tool simply inserts the teeth a few more levels deeper past the pin 26. Since the insert is compressible the insert will accept tighter locked fits. Once locked, the secured screwdriver or other tool or item cannot be readily removed from the security mechanism without either tediously disassembling the tool from the holder or breaking open the locking means. In the least secure level, the tool may be twisted about its axis and in the most secure level, the tool is fixed in one position.

Advantageously, this overall scheme of the invention allows the potential customer to grip the tool handle and get a sense of how the tool feels before purchasing the same, while making it difficult, if not impossible, for the unscrupulous person to product price switch.

Furthermore, the same tool holder may be, advantageously, shipped to a wider range of retailers/wholesalers who have different security packaging requirements. This will reduce packaging costs of a tool or a tool set.

Another advantage the flows from the invention is the fact that the packaging avoids the flimsy look of a blister package typically associated with traditional packaging of the tools. The invention, also advantageously, provides for single piece holder to be integrally molded holder thereby allowing a sturdy and durable package.

A multiple screwdriver holder embodiment is shown in FIGS. 13–19 having a security mechanism similar to that described above and having similar advantages that flow from its design. In this embodiment of the invention, a number of screwdrivers 50 are stored in the holder base 40 by aligning the bore 51 of the handle into upwardly extending tabs 44 and the shafts with recessed cuts 43 of the support members 42. The screwdrivers stored in the base are held in place by the combination of strap 46 and label card 45. This strap and card combination is connected to the holder via a living hinge and locks therewith via thumb tack 48—hole 49 combination. The locking mechanism according to the invention is applied as shown in FIGS. 16–19, such that one of the screwdrivers has its handle fully exposed for the prospective purchaser to feel. The strap 46 prevents the remainder of the screwdrivers from being removed easily.

Figure 20:
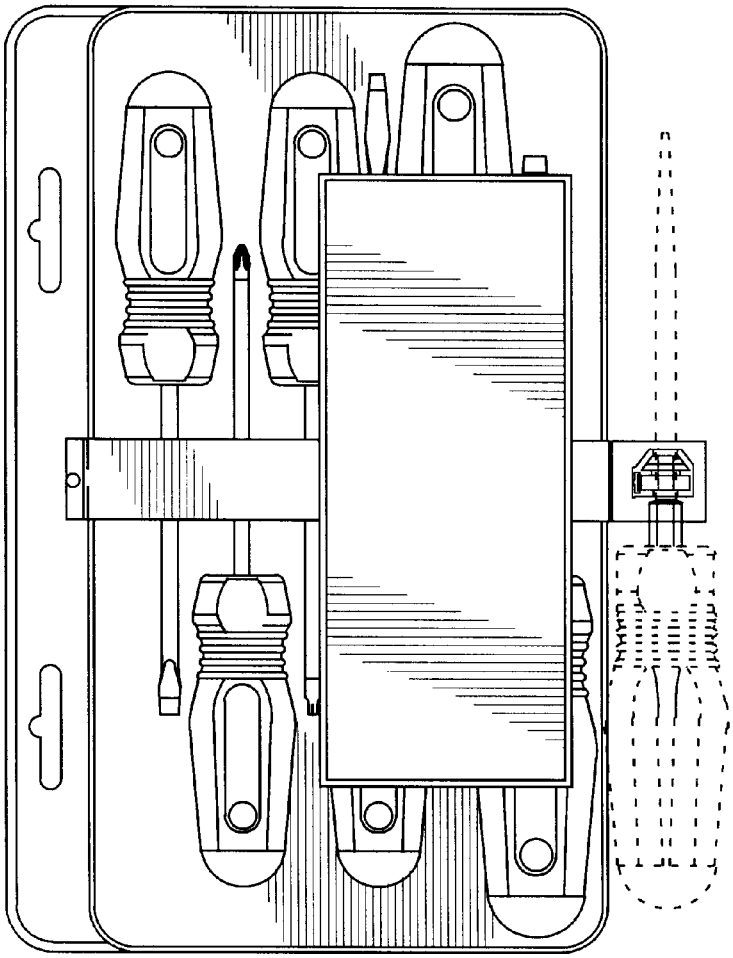
FIGS. 20–24 are various views of an alternative embodiment of the tool holder that permits rotation of the security mechanism to allow the screwdriver to be stored during shipping/storage.
Figure 21:
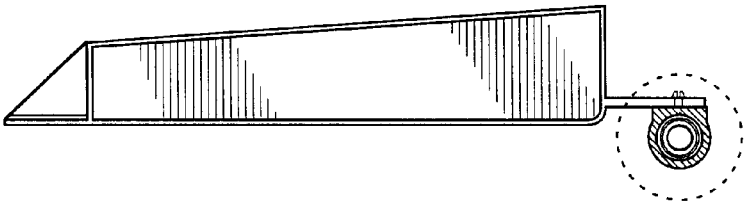
Figure 22:
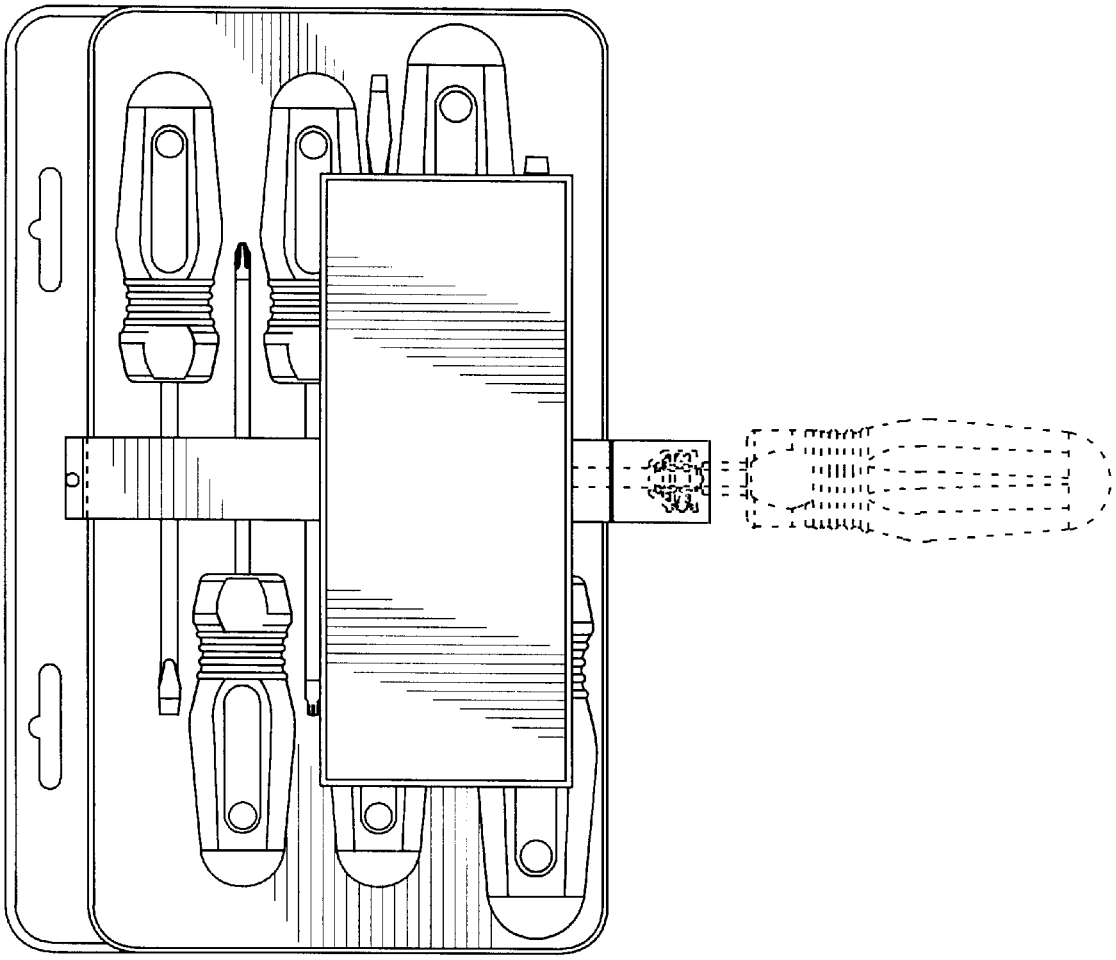
Figure 23:
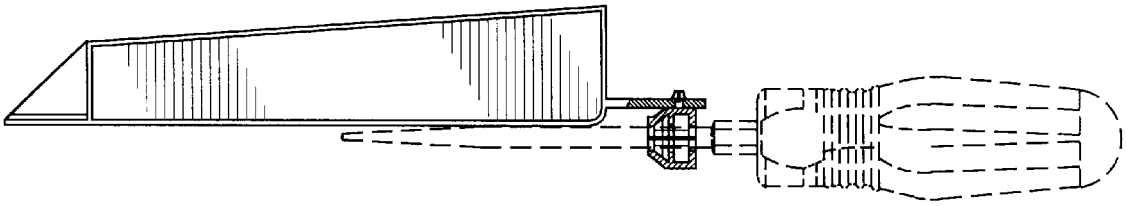
Figure 24:
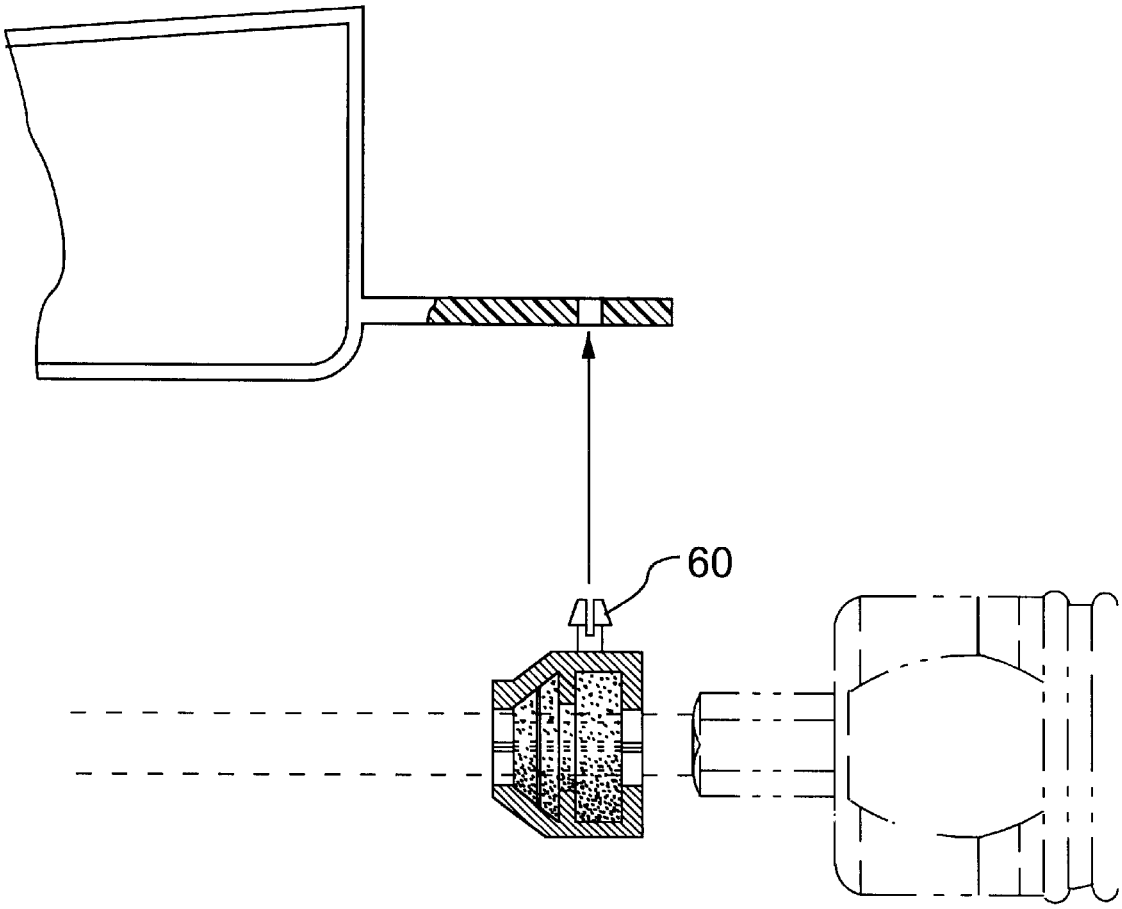
Figure 25:
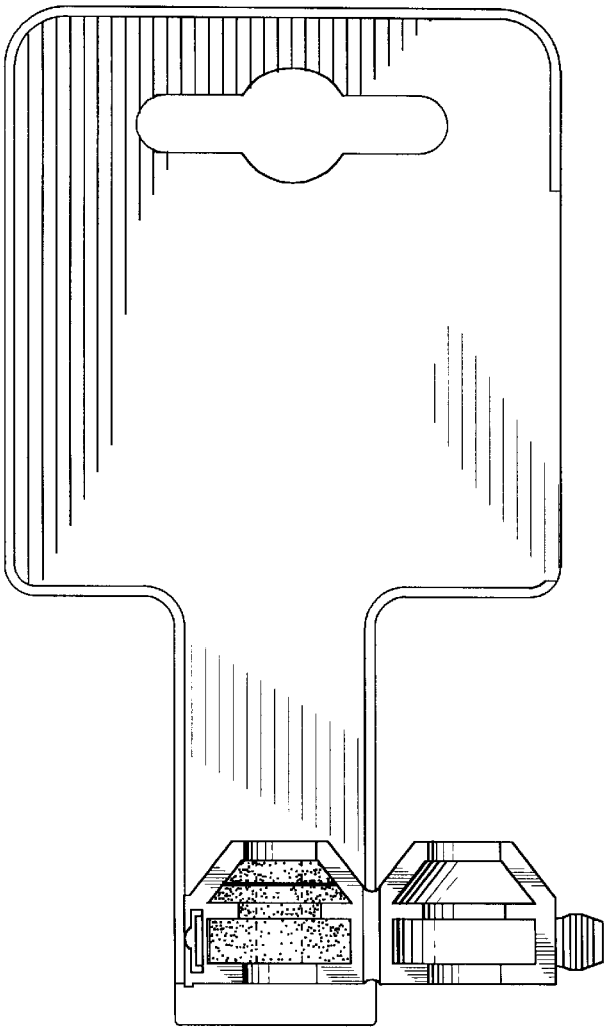
FIGS. 25–29 are various views of another embodiment of the invention in which a rib in the recess has been added to 'bite' into the rubber insert thus causing added compression.
Figure 26:
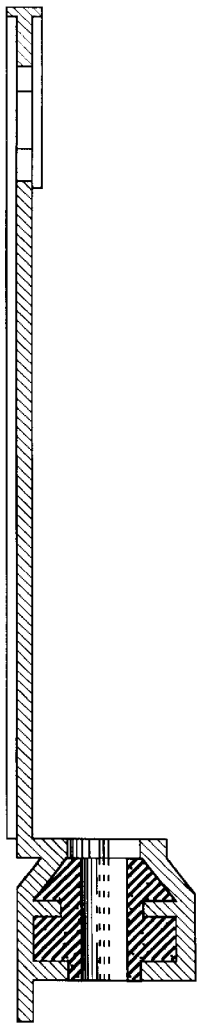
Figure 27:
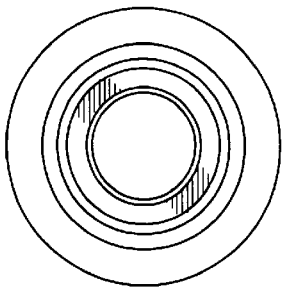
Figure 28:
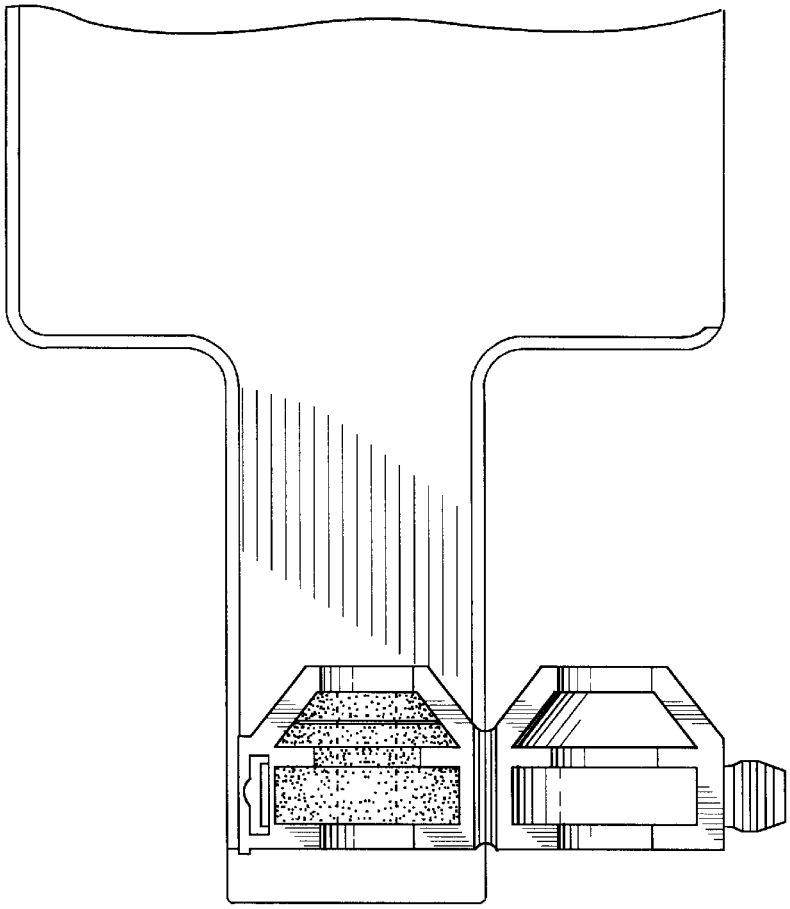
Figure 29:
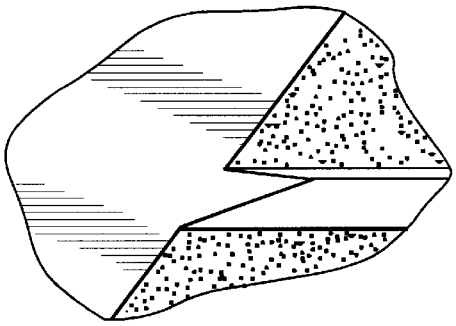

FIGS. 20–24 are various views of an alternative embodiment of the tool holder, similar to the one shown in FIGS. 13–19, which permits rotation of the security mechanism to allow the screwdriver to be rotated from the shipping/storage position of FIGS. 20–21, to the preferred display position of FIGS. 22–23, by virtue of pivotal mounting of the security mechanism via a mushroom pin 60, best seen in FIG. 24.

FIGS. 25–29 are various views of another embodiment of the invention in which a rib in the recess has been added to 'bite' into the rubber insert thus causing added compression of the insert, for more force against the tool.

Figure 30:
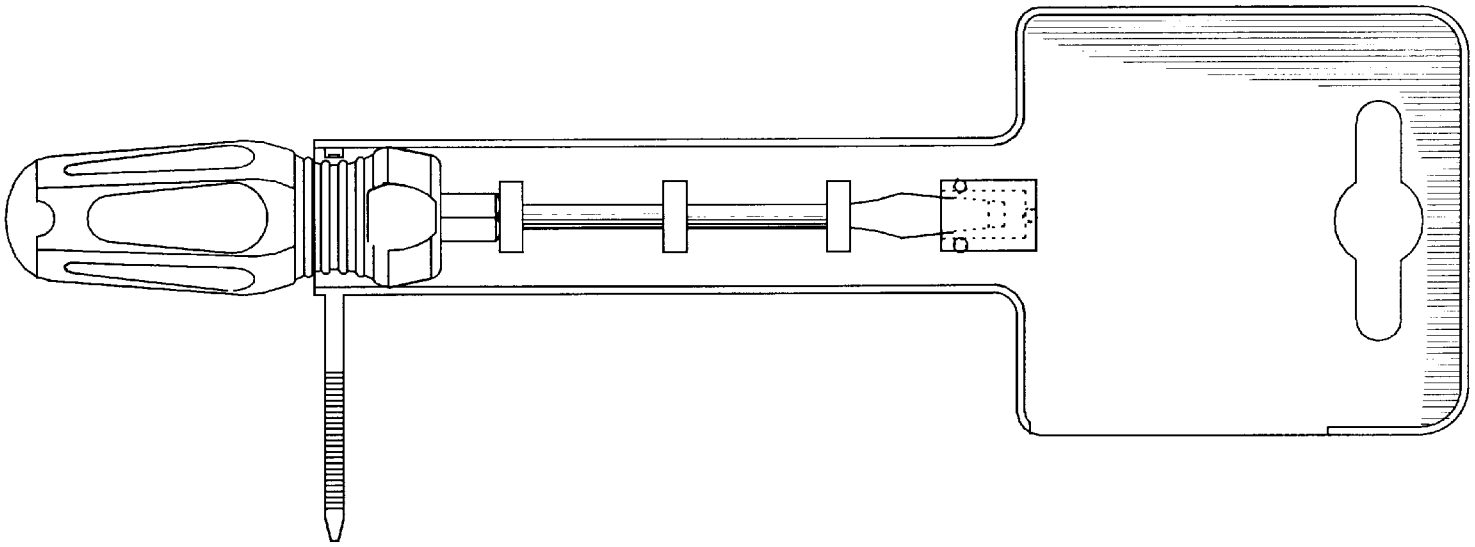
FIG. 30 is a front view of an alternative embodiment.
Figure 31:
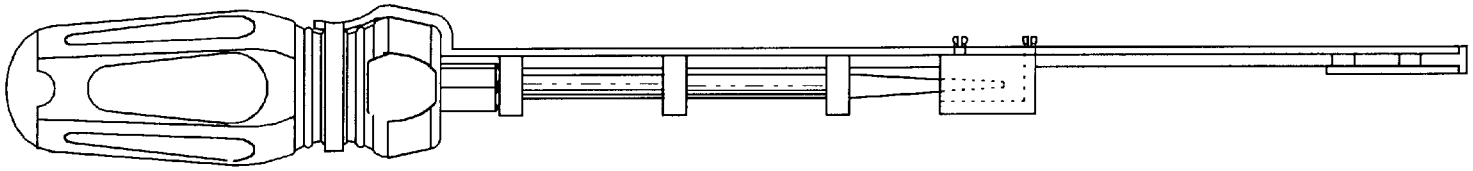
FIG. 31 is a side view of the FIG. 30 embodiment.
Figure 32:
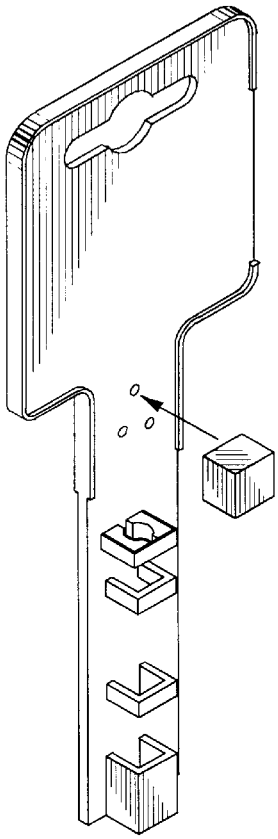
FIGS. 32–34 are perspective views of another alternative embodiment.
Figure 33:
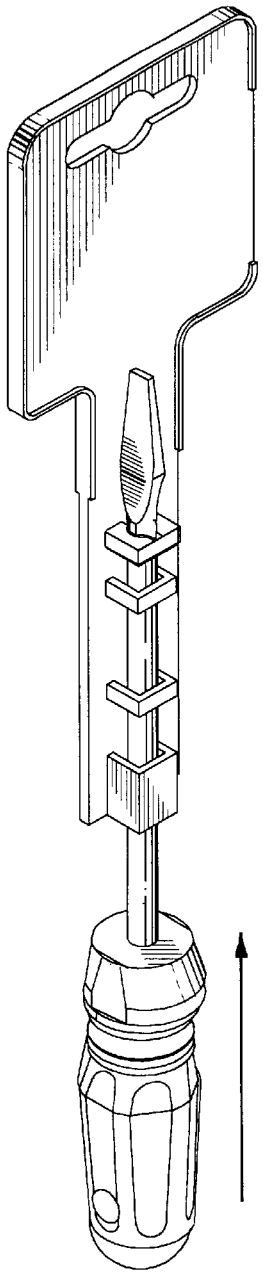
Figure 34:
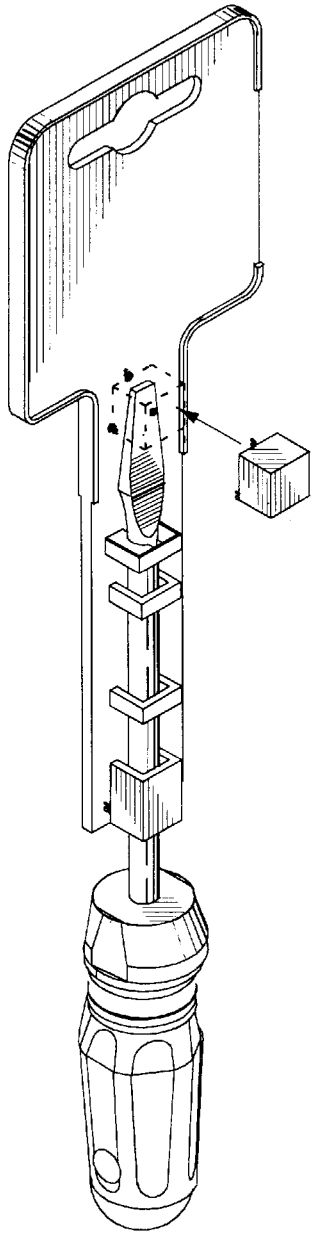
Figure 35:
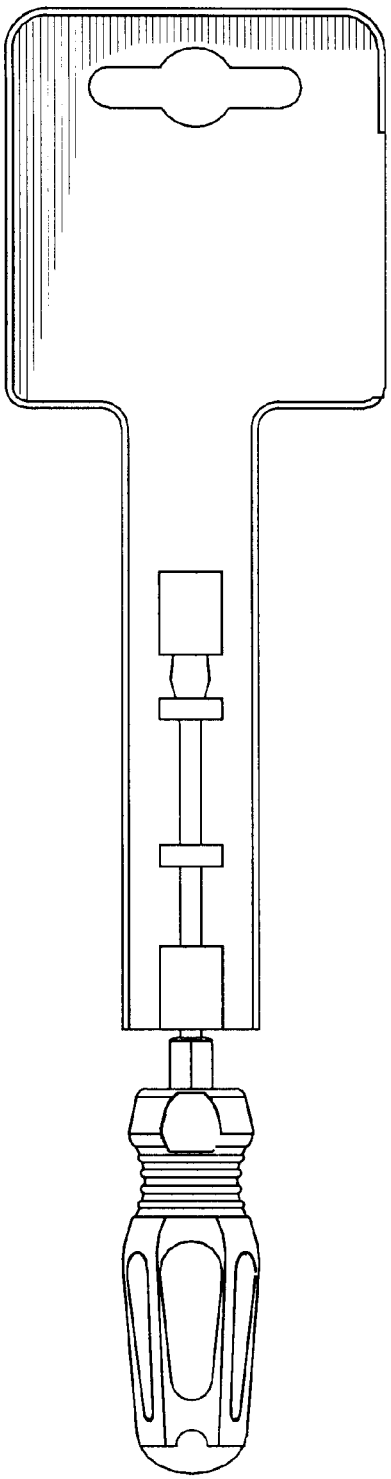
FIG. 35 is a front view of the embodiment of FIGS. 32–34.
Figure 36:
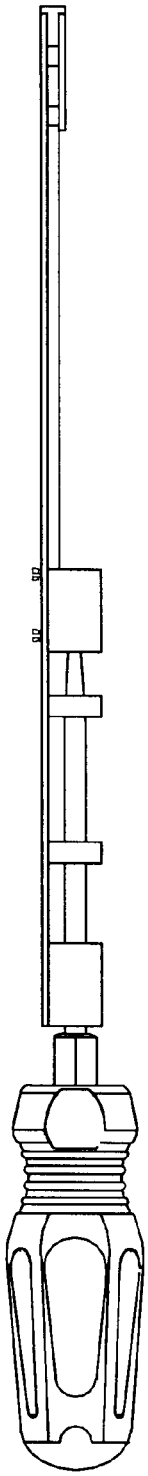
FIG. 36 is a side view of the embodiment of FIGS. 32–34.
Figure 38:
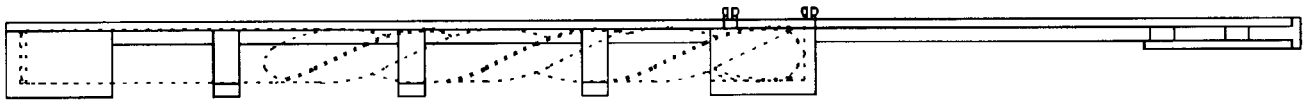
FIG. 38 is a side view of the FIG. 37 embodiment.
Figure 37:
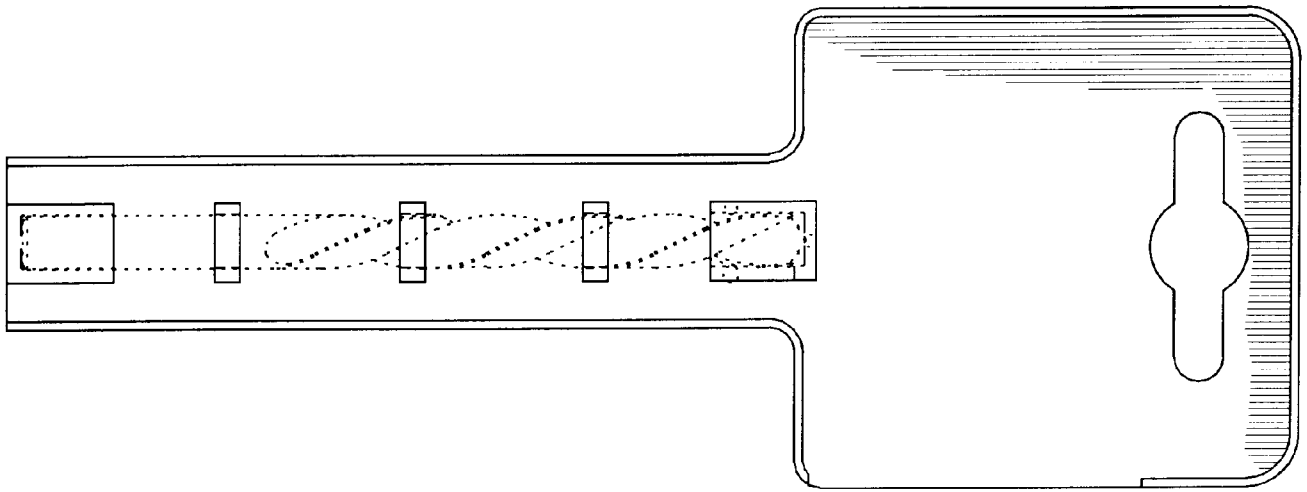
FIG. 37 is a blank view of side view of an alternative embodiment, configured for a drill bit.

FIGS. 30–31 show an alternative embodiment, having a ratcheting locking strap which wraps around the handle of the screwdriver, and a snap-on cap to fit over the end of the screwdriver.

FIGS. 32–36 are various views of a similar alternative embodiment, further having a locking clip which fits closely around the screwdriver shaft and then snaps into place on the card. In this embodiment, the ratcheting locking strap is not necessary, although obviously it could be used as well for greater security.

It will be appreciated that the above description relates to the preferred embodiment by way of example only. Many variations on the invention will be obvious to those knowledgeable in the field, and such obvious variations are within the scope of the invention as described and claimed, whether or not expressly described.

Figure 2A:
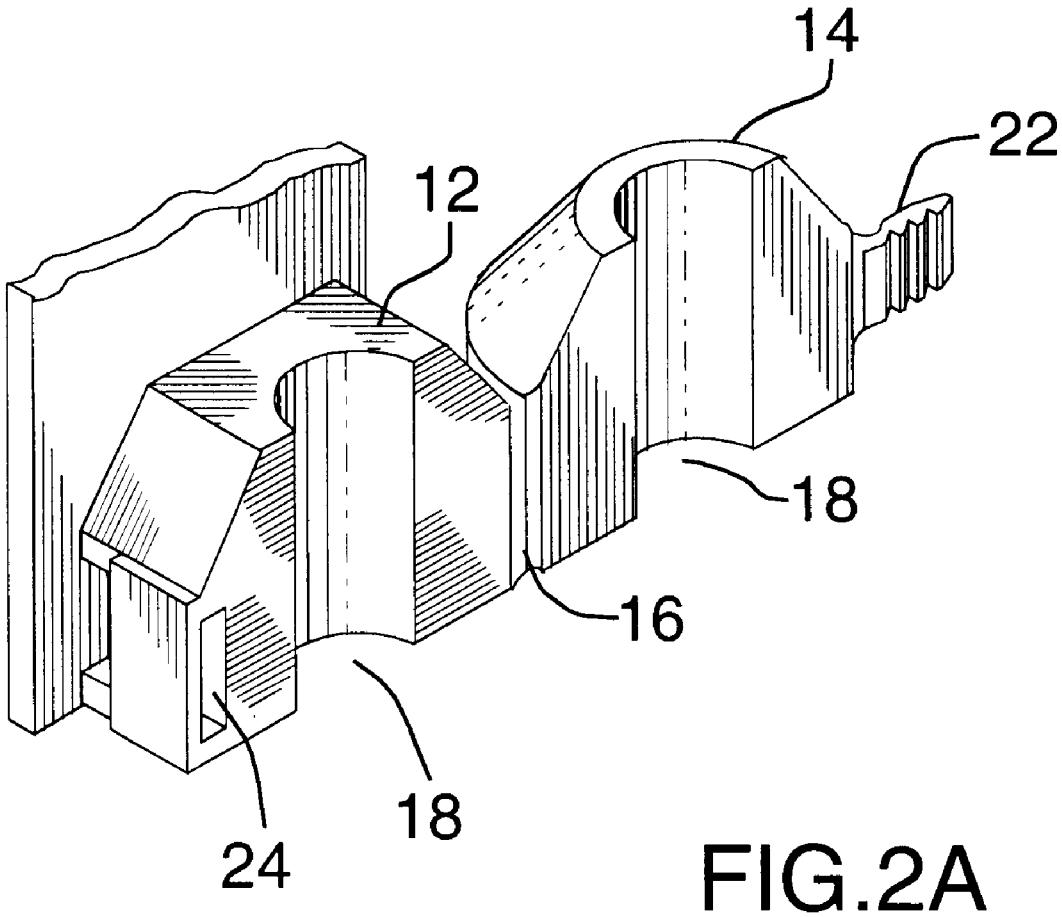
FIG. 2*a* is close-up perspective view of another embodiment of the shaft security mechanism.

For example, the security mechanism may be used without the insert at all. What is required in this instance is that the hole 15 have an interference fit with the shaft of the tool and/or the diameter of the hole be less than the width of the flared ends of the secured screwdriver. In this embodiment of the invention, as shown in FIG. 2*a*, the recesses may be shaped to receive only the tool shaft portion. As a further embodiment of the invention, the recessed portion of the members may instead be coated with a rubberized layer in lieu of the compressible insert.

What is claimed as the invention is:

1. A tool holder comprising at least one first member and at leas one corresponding second member securable to the first member, said first and second members defining at least one cavity between each of them, open at opposite ends, for a tool to extend through said cavity, in combination with a resilient insert positionable within said cavity and around said tool to securely retain said tool by friction within said cavity, wherein securing said second member to said first member compresses said resilient insert against said tool when said resilient insert is positioned on said tool.

2. A tool holder as recited in claim 1, wherein said cavity additionally has at least one rib extending therefrom into the resilient insert at an angle opposing a direction in which the tool would be withdrawn, so as to cause added compression of the insert, for more force against the tool.

3. A tool holder as recited in claim 1, wherein said resilient insert is trapped within said cavity when said second member is secured to said first member.

4. A tool holder as recited in claim 2, wherein said resilient insert has at least one annular channel to receive at least one corresponding annular intermediate tier extending inwardly from said members within said cavity.

5. A tool holder as recited in claim 4, wherein said cavity additionally has at least one rib extending therefrom into the resilient insert at an angle opposing a direction in which the tool would be withdrawn, so as to cause added compression of the insert, for more force against the tool.

6. A tool holder as recited in claim 4, wherein said resilient insert is trapped within said cavity when said second member is secured to said first member.

7. A tool holder as recited in claim 5, wherein said resilient insert is trapped within said cavity when said second member is secured to said first member.

8. A tool holder as recited in claim 1, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

9. A tool holder as recited in claim 2, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

10. A tool holder as recited in claim 3, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

11. A tool holder as recited in claim 4, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

12. A tool holder as recited in claim 5, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

13. A tool holder as recited in claim 6, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

14. A tool holder as recited in claim 7, wherein said second member is securable to said first member by virtue of a living hinge between said members along one edge thereof, and a locking means along an opposite edge, said locking means comprising a plurality of teeth on at least one tab on one of said members and a corresponding catch on the other said member to engage one of the teeth.

* * * * *